United States Patent [19]

Koenigsberg

[11] Patent Number: 4,827,494

[45] Date of Patent: May 2, 1989

[54] X-RAY APPARATUS

[75] Inventor: William D. Koenigsberg, Concord, Mass.

[73] Assignee: GTE Laboratories Incorporated, Waltham, Mass.

[21] Appl. No.: 133,864

[22] Filed: Dec. 16, 1987

[51] Int. Cl.[4] ..... H01J 35/14

[52] U.S. Cl. ..... 378/138; 378/137; 378/207

[58] Field of Search ..... 378/137, 138, 113, 207; 250/399

[56] References Cited

U.S. PATENT DOCUMENTS

| | | | |
|---|---|---|---|
| 2,946,892 | 7/1960 | Bas-Taymaz | 378/137 |
| 3,955,089 | 5/1976 | McIntyre et al. | 250/399 |
| 4,356,400 | 10/1982 | Polizzi et al. . | |
| 4,442,539 | 4/1984 | Aichinger et al. . | |
| 4,464,778 | 8/1984 | Goldmann . | |
| 4,532,646 | 7/1985 | Gilbert . | |
| 4,675,891 | 6/1987 | Plessis et al. | 378/207 |

OTHER PUBLICATIONS

"Position Sensing with Lateral Effect Photodiodes", B. O. Kelly, Proc. SPIE, vol. 129, 1977.

*Primary Examiner*—Carolyn E. Fields
*Assistant Examiner*—David P. Porta
*Attorney, Agent, or Firm*—David M. Keay

[57] ABSTRACT

X-ray apparatus of the type in which X-rays are generated by an electron beam impinging on a focal spot on a metal target. Heat from the focal spot is focused onto a lateral effect photodiode, the electrical output of which changes with changes in the position of the focal spot. This output is fed back to the electron beam deflection coils to change the direction of the electron beam and steer it back toward the original, intended position of the focal spot on the target.

4 Claims, 2 Drawing Sheets

X-RAY APPARATUS

BACKGROUND OF THE INVENTION

This invention relates to X-ray apparatus. More particularly, it is concerned with apparatus in which the source of X-rays is a metal target bombarded with an electron beam.

An essential element of any X-ray radiographic imaging system is a source of X-ray radiation. One common technique for providing this source is by bombarding a metal target with a beam of electrons in a high vacuum environment. The size of the spot where the electron beam strikes the target affects the resolution or clarity observed in a film image of an object exposed to the X-ray radiation. The smaller the spot, the sharper the resulting image. If the spot moves due to any of a number of factors while the X-ray film is being exposed, the resulting image suffers some distortion.

Many X-ray systems have focal spots ranging from 0.4 millimeters to 3 millimeters in diameter. Slight motion of the spot, of the order of tens of micrometers, does not significantly affect the clarity or sharpness of a radiographic image because this relatively large spot causes a predominant blurring or unsharpness that masks the effect of this motion. The effects of the motion of the X-ray focal spot, however, are more noticeable when the spot is smaller. Presently available microfocus X-ray systems produce a focal spot on the order of 10 micrometers in diameter. Motion of such a focal spot during the period of an exposure, even if the motion is less than 10 micrometers, can be a serious problem. The problem is especially acute when long exposures are required or image magnification is employed or tomographic imaging (CAT scanning) is involved. It is, therefore, desirable to maintain the X-ray focal spot relatively stationary with respect to the target during the period of exposure in order to eliminate motion-induced distortion.

SUMMARY OF THE INVENTION

X-ray apparatus in accordance with the present invention comprises a target for producing X-rays in response to an electron beam impinging on a surface thereof. The target also radiates heat from the focal spot on the surface of the target toward which the electron beam is directed. The apparatus includes means for producing an electron beam directed toward the surface of the target and deflection means for deflecting the electron beam to control the position of the focal spot on the surface of the target. Lateral effect radiation detecting means are arranged to receive on a surface thereof an image of the heat radiated from the focal spot on the surface of the target. The lateral effect radiation detecting means is operable to produce signals indicative of the position of the image of the focal spot on the surface of the lateral effect radiation detecting means. Adjustment means are coupled to the lateral effect radiation detecting means and to the deflection means and operate in response to signals from the lateral effect radiation detecting means indicating a change in the position of the image of the focal spot on the surface of the lateral effect radiation detecting means when the electron beam shifts direction moving the focal spot from one position to another position on the surface of the target, to cause the deflection means to deflect the electron beam so as to move the focal spot toward said one position on the surface of the target.

For a better understanding of the present invention, together with other and further objects, advantages, and capabilities thereof, reference is made to the following disclosure and appended claims in connection with the above described drawings.

DETAILED DESCRIPTION

Figure 1:
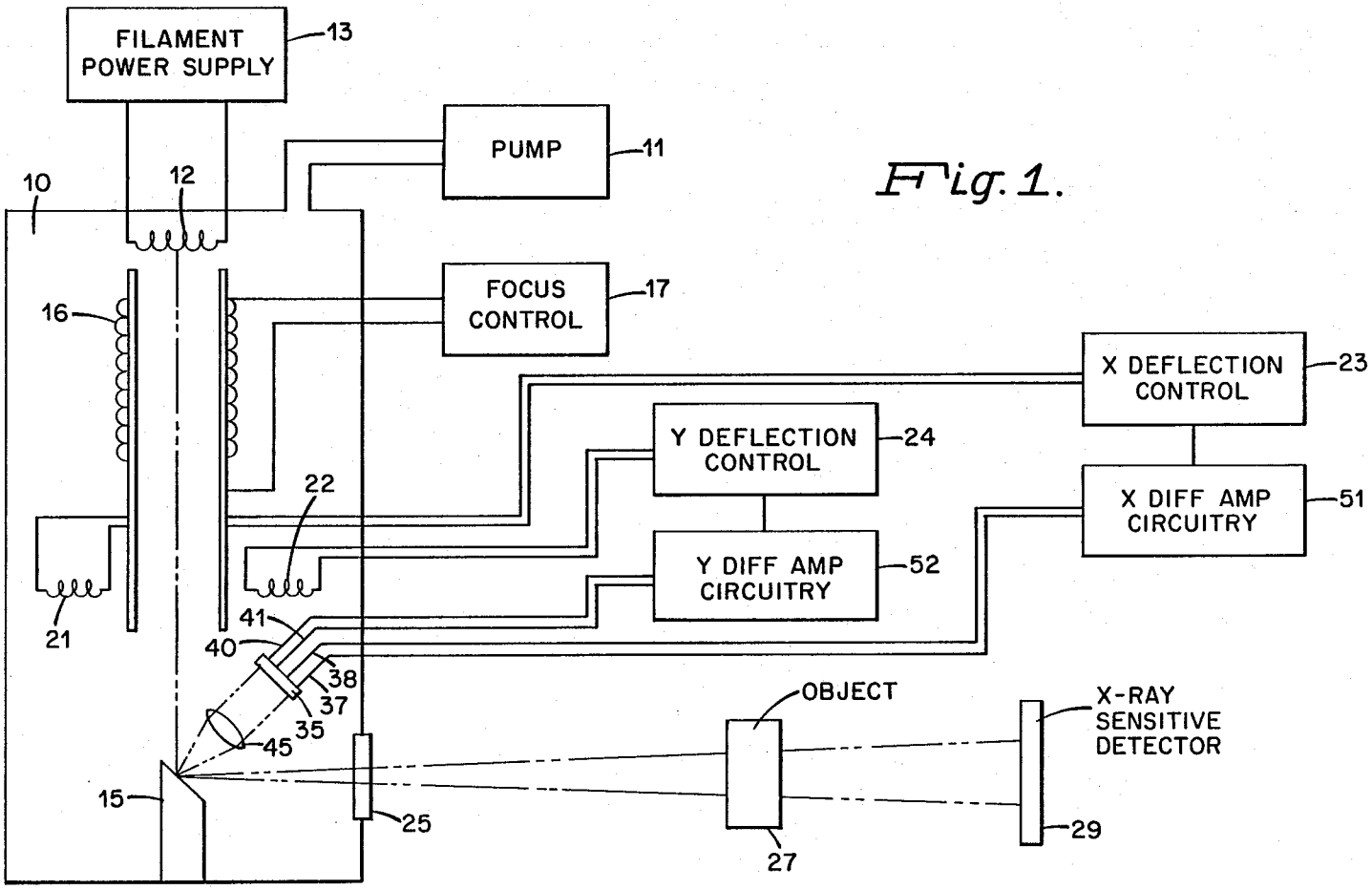
FIG. 1 is a schematic representation of X-ray apparatus in accordance with the present invention.
Figure 2:
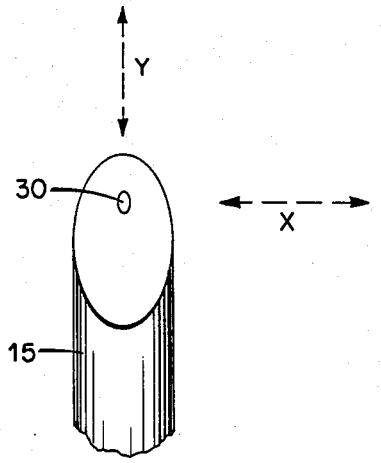
FIG. 2 is a view illustrating the surface of a target of the apparatus of FIG. 1 undergoing bombardment by an electron beam.

FIG. 1 is a schematic representation of X-ray apparatus in accordance with the present invention. The apparatus includes a chamber 10 which is sealed and in which a high vacuum is produced by a suitable exhaust pump 11. The apparatus includes a source of electrons for an electron beam comprising a filament 12 connected to a filament power supply 13. The electrons from the filament source 12 are directed onto a surface of a target 15 of a suitable metal, for example tungsten. The electron beam is focused by a focusing coil 16 which is controlled by a focus control 17. X and Y deflection coils 21 and 22 are arranged orthogonally to each other and serve to control the direction of the electron beam in an X direction and Y direction, respectively, and hence the position of the focal spot 30 at which the electron beam impinges on the target 15 as shown in FIG. 2. Control voltages to the X and Y deflection coils 21 and 22 are provided by deflection controls 23 and 24, respectively. Since the target becomes pitted after several exposures at high power levels, the deflection controls 23 and 24 can be used to locate the focal spot at a fresh portion of the target surface.

As is well understood, the electron beam bombards the surface of the target 15 causing it to emit X-rays from the focal spot 30. The X-rays pass through a collimator 25 in the walls of the chamber 10. The X-rays are directed onto an object 27 and onto an X-ray sensitive detector 29 which may be X-ray film for recording an image of the object 27 subjected to the X-rays. The apparatus as described is standard, conventional microfocus X-ray apparatus widely used in industry.

X-ray apparatus in accordance with the present invention also includes elements for detecting motion of the focal spot of the electron beam on the surface of the target from its original, intended position, and for moving the focal spot towards its original, intended position. The X-ray focal spot 30 produced by the electron beam bombarding the target 15 is extremely hot. About 99 percent of the energy in the electron beam is converted to heat while approximately 1 percent is converted to X-ray radiation. Apparatus in accordance with the present invention employs the heat radiated by the focal spot to determine the position of the focal spot on the surface of the target 15.

Figure 3:
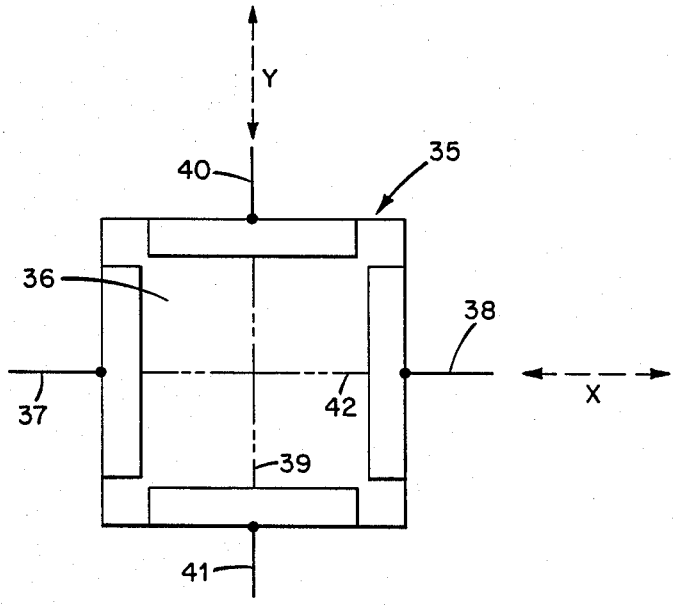
FIG. 3 is a representation of a lateral effect photodiode employed in the apparatus of FIG. 1.

A lateral effect photodiode 35 is mounted within the vacuum chamber 10 as illustrated in FIG. 1. The lateral effect photodiode 35 is also illustrated in FIG. 3. The lateral effect photodiode is a planar type silicon photodiode which operates effectively as a heat sensitive detector of radiation within infra-red wavelengths impinging on its sensitive surface 36. The device produces an output voltage between two opposite terminals 37 and 38 when the centroid of received radiation to which it is sensitive is to the right or left (as viewed in FIG. 3) of a first axis 39 on the sensitive surface 36 midway between the terminals 37 and 38. The output voltage is proportional to the distance of the centroid of received radiation from the first axis 39. Similarly, the device produces an output voltage between terminals 40 and 41 proportional to the distance of the centroid of received radiation from a second axis 42 midway between the terminals 40 and 41 and orthogonal to the first axis 39. Devices of this type are available from Hamamatsu Systems Inc., Waltham, Massachusetts. Additional details concerning lateral effect photodiodes may be found in an article entitled, "Position Sensing with Lateral Effect Photodiodes", by B. O. Kelly, published in Proc. SPIE vol. 129, 1977.

As illustrated in FIG. 1 a suitable focusing arrangement 45 is employed to focus an image of the surface of the target 15 with the focal spot 30 onto the sensitive surface 36 of the lateral effect photodiode 35. Alternatively, a fiber optic system may be employed to receive an image of the surface of the target 15 and transmit the image to a lateral effect photodiode mounted elsewhere, internally or externally of the chamber.

The output voltage from terminals 37 and 38 of the lateral effect photodiode 35 are applied to X differential amplifier circuitry 51. The X differential amplifier circuitry 51 is connected to the X deflection control 23 to adjust the voltage produced by the X deflection control to the X deflection coil 21. Similarly, the output terminals 40 and 41 of the lateral effect photodiode are connected to Y differential amplifier circuitry 52. The Y differential amplifier circuitry 52 is connected to the Y deflection control 24 to adjust the voltage applied to the Y deflection coil 22.

In operating the apparatus, the X deflection control 23 and Y deflection control 24 are manipulated to direct the electron beam onto a desired focal spot 30 on the surface of the target 15. Under operating conditions, if the focal spot 30 on the surface of the target 15 toward which the electron beam is directed moves from its original, intended position, the image of the infra-red radiation on the sensitive surface 36 of the lateral effect photodiode 35 also moves. Consequently the output voltages from the lateral effect photodiode 35 to one or both of differential amplifier circuitry 51 and 52 change. The differential amplifier circuitry 51 and 52 in turn produce appropriate signals to the X and Y deflection controls 23 and 24 adjusting the voltages to the deflection coils 21 and 22 to shift the direction of the electron beam in the compensatory direction to impinge on the position of the original, intended focal spot.

By virtue of the closed-loop feedback arrangement as described, any drift of the electron beam, regardless of the cause, tends to be corrected by redirecting the focal spot back towards its original, intended position. If the redirection occurs rapidly, the net effect of the drifting of the focal spot is greatly reduced. The use of such a system to stabilize the position of a small focal spot, of the order of 10 micrometers in diameter, is of great advantage because it reduces or eliminates a source of distortion of the final image on the sensitive detector 29 which would tend to cause confusion during visual interpretation of the X-ray radiographic image, particularly for long exposure periods. The arrangement makes use of the heat or infra-red radiation from the focal spot 30 on the target 15 rather than the X-ray radiation itself. In addition, the placement of the lateral effect photodiode is such that it does not interfere with the generation or transmission of the X-ray beam.

While there has been shown and described what is considered a preferred embodiment of the present invention, it will be obvious to those skilled in the art that various changes and modifications may be made therein without departing from the invention as defined by the appended claims.

What is claimed is:

1. X-ray apparatus comprising a target for producing X-rays in response to an electron beam impinging on a surface thereof, said target radiating heat from the focal spot on said surface toward which the electron beam is directed;

means for producing an electron beam directed toward said surface of the target;

deflection means for deflecting the electron beam to control the position of the focal spot on said surface of the target;

lateral effect radiation detecting means arranged to receive on a surface thereof an image of the heat radiated from the focal spot on the surface of the target;

said lateral effect radiation detecting means being operable to produce signals indicative of the position of the image of the focal spot on said surface of the lateral effect radiation detecting means; and adjustment means coupled to said lateral effect radiation detecting means and to said deflection means and operable in response to signals from said lateral effect radiation detecting means indicating a change in the position of the image of the focal spot on said surface of the lateral effect radiation detecting means when the electron beam shifts direction moving the focal spot from one position to another position on the surface of the target, to cause the deflection means to deflect the electron beam so as to move the focal spot toward said one position on the surface of the target.

2. X-ray apparatus in accordance with claim 1 wherein said lateral effect radiation detecting means includes a lateral effect photodiode which is sensitive to infra-red radiation and has a sensitive surface for receiving radiation;

said lateral effect photodiode producing a first output voltage at first output connections which is proportional to the distance between the centroid of the infra-red radiation focused on said sensitive surface and a first axis passing through a voltage null point on said sensitive surface; and said lateral effect photodiode producing a second output voltage at second output connections which is proportional to the distance between the centroid of the infra-red radiation focused on said sensitive surface and a second axis passing through said voltage null point orthogonal to said first axis.

3. X-ray apparatus in accordance with claim 2 wherein said deflection means includes an X deflection coil and a Y deflection coil orthogonal thereto disposed adjacent to the electron beam;

said X deflection coil being operable to control the direction of the electron beam along an X direction in response to the voltage applied thereto; and said Y deflection coil being operable to control the direction of the electron beam along a Y direction orthogonal to said X direction in response to the voltage applied thereto.

4. X-ray apparatus in accordance with claim 3 wherein said adjustment means includes X differential amplifier means coupled to said first output connections of said lateral effect photodiode and to said X deflection coil and operable to cause voltage applied to the X deflection coil to change in response to a change in the first output voltage from the lateral effect photodiode so as to shift the electron beam in the X direction and move the position of the focal spot on said surface of the target toward said one position; and Y differential amplifier means coupled to said second output connections of said lateral effect photodiode and to said Y deflection coil and operable to cause the voltage applied to the Y deflection coil to change in response to a change in the second output voltage from the lateral effect photodiode so as to shift the electron beam in the Y direction and move the position of the focal spot on said surface of the target toward said one position.

* * * * *